United States Patent [19]

Hieronymus

[11] 4,277,769

[45] Jul. 7, 1981

[54] ARRANGEMENT FOR COOLING A SUPERCONDUCTION MAGNET COIL WINDING

[75] Inventor: Hans Hieronymus, Erlangen, Fed. Rep. of Germany

[73] Assignee: Siemens Aktiengesellschaft, Berlin and Munich, Fed. Rep. of Germany

[21] Appl. No.: 110,105

[22] Filed: Jan. 9, 1980

[30] Foreign Application Priority Data

Jan. 15, 1979 [DE] Fed. Rep. of Germany ..... 2901333

[51] Int. Cl.[3] ..... H01F 7/22

[52] U.S. Cl. ..... 335/216; 174/126 S

[58] Field of Search ..... 335/216; 336/DIG. 1, 336/60; 174/126 S

[56] References Cited

U.S. PATENT DOCUMENTS

| | | | |
|---|---|---|---|
| 3,613,006 | 10/1971 | Kantrowitz et al. | 335/216 |
| 3,869,686 | 3/1975 | Benz | 335/216 |
| 3,946,348 | 3/1976 | Schleich | 335/216 |
| 4,189,693 | 2/1980 | Satti | 335/216 |

*Primary Examiner*—George Harris

*Attorney, Agent, or Firm*—Kenyon & Kenyon

[57] ABSTRACT

In an arrangement for forced cooling of a magnet coil winding with coolant connecting points for feeding in and discharging a coolant into and from the winding, the superconducting conductors of which have operating points which have different deviations from the respective nearest transition point of the superconductive material, the coolant connecting point for discharging the coolant from the winding is disposed at the coolant connecting point with the shortest distance to that conductor zone of the winding, the operating point of which is closest to a transition point to thereby prevent a spread of a quench starting at this critical conductor zone, through the coolant.

5 Claims, 1 Drawing Figure

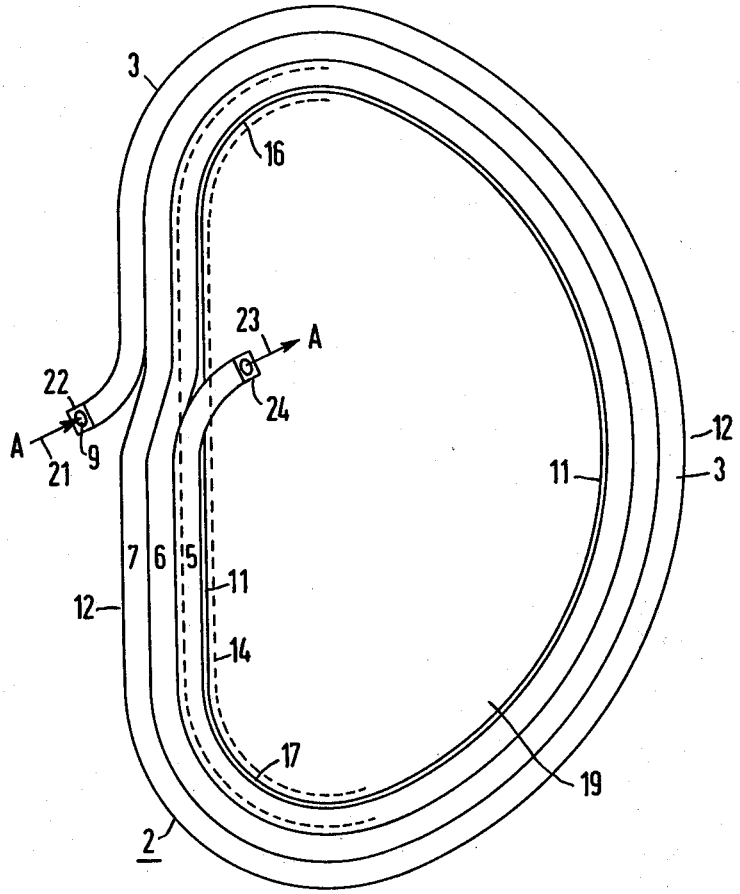
3
16
23
A
22
24
A
21
9
12
3
11
7
6
5
11
12
14
17
19
2

ARRANGEMENT FOR COOLING A SUPERCONDUCTION MAGNET COIL WINDING

BACKGROUND OF THE INVENTION

The invention relates to superconducting magnet coil windings in general and more particularly to an improved cooling arrangement for such a winding.

More specifically the present invention is directed to an improvement in an arrangement for cooling a magnet coil winding containing conductors of superconductive material which are cooled by means of a forced flow of a coolant which is fed into the winding at at least one coolant connecting point and is discharged again from the winding at at least one further coolant connecting point. The conductors are subdivided into conductor zones, the operating points of which, being fixed by the current density I, the field strength H and the temperature T, have different deviations from the transistion point of the superconductive material from the superconducting to the normally conducting state which is closest in an I-H-T space and is determined by the critical current density $I_c$, the critical field strength $H_c$ and the critical temperature $T_c$.

Magnet windings with superconductors can be used to advantage for producing strong magnet fields with large physical dimensions. Conductor materials which can be considered for this purpose are, for instance, niobium-zirconium or niobium-titanium alloys as well as niobium-tin compounds. Conductors of these superconductor materials are generally stabilized by a normally conducting material and are, for instance, embedded in a matrix of this material. With this measure, the destruction of the superconductors in the event of an uncontrolled transistion of its parts consisting of the superconductor material from the superconducting to the normally conducting state is to be prevented. In arrangements for cooling superconducting magnets of great dimensions "forced" cooling is often provided (cf., CERN-Report 68-17, Nuclear Physics Division, Geneva, May 13, 1968). With this cooling technique, a coolant, for instance, liquid helium, is continuously pumped through discrete cooling canals which are developed in the winding. Cooling canals can be formed, particularly, by appropriate voids in the superconducting conductors themselves. Such conductors are therefore generally called hollow conductors. With this cooling technique, a helium bath cryostat, which would otherwise be required for cooling the winding of the magnet coil, can be dispensed with and can be replaced by a simple vacuum chamber which encloses the winding and merely serves for the thermal insulation of the winding from the outside. In a magnet winding with hollow conductors or corresponding cooling canals arranged between adjacent conductors, the amount of liquid coolant required for cooling the winding can be reduced considerably over a magnet of approximately equal size with coolant bath cooling. This is of advantage particularly in the event of a transistion of the winding from the superconducting to the normally conducting state, because then only relatively little liquid coolant can evaporate. In addition, magnet windings with hollow conductors, contrary to most windings with a cooling bath, can have any orientation in space. Changes in position during operation are then also possible.

The operating data for the conductors of such a magnet coil winding are different within the winding during undisturbed operation. This means that the winding has conductor zones, the operating data of which with respect to the superconduction properties are more critical than the data of adjacent conductor zones. The operating point of such a critical conductor zone defined by the operating data is therefore closer to the nearest transition point from the superconducting to the normally conducting state, determined by the critical data of the superconductive material of the conductors, than the operating points of other conductor zones. This transition point is determined mainly by the critical current density $I_c$, the critical field strength $H_c$ or the critical magnet induction $B_c$, respectively, and the critical temperature $T_c$ of the conductor material and is located on a three-dimensional surface in the I-H-T space for which the superconducting state is present, from those for which only normal conduction prevails (Proc. IEE, IEE Review, vol 199, no. 8R, Aug. 1972, page 1007). If, for instance, a conductor zone is situated in a zone of particularly high magnetic field strength which is greater than the field strength in adjacent conductor zones, then the operating data of this conductor zone are closer to the associated transition point than in adjacent conductor zones if the temperature and current density conditions in the conductor zones being compared to each other are at least approximately equal.

An unintentional transition of a superconducting magnet winding to the normally conducting state, which is also called a "quench", often starts from such a critical conductor zone of the winding which is subject to particularly extreme conditions, for instance, particularly high magnetic field strength or a particularly large heat exposure. In order to prevent, in the event of such a quench, the normal conducting zone from spreading through heat condition relatively fast over the entire coil and therefore, accordingly, a situation where much energy must be taken out of the magnet, one will generally endeavor to obtain particularly good cooling of these critical zones. Heretofore, it has been attempted to ensure this by feeding the coolant into the magnet at least in the vicinity of these critical zones, since it is still coolest there and can therefore remove more heat. However, if the winding becomes normally conducting in this critical conductor zone, for instance, because of the particularly high field strength prevailing there, the increased temperature generated by the flow of the electric current is not only passed on lengthwise and crosswise to the conductors in adjacent conductor zones due to heat conduction, but is transported into these conductor zones also by the heated coolant.

The present invention is thus based on the insight that a problem exists in the known arrangements for forced cooling of superconducting magnet windings in that these arrangements further aid the spreading of the normally conducting zone through the coolant. It is therefore an object of the present invention to provide an arrangement for cooling a superconducting magnet winding in which this danger does not exist.

SUMMARY OF THE INVENTION

According to the present invention, this problem is solved, for a cooling arrangement of the type mentioned at the outset, by providing, at the coolant connecting point with the comparatively smallest distance from the conductor zone, the operating point of which is comparatively closest to a transition point of the superconductive material in the I-H-T space, an outlet for the coolant from the winding.

An outlet of the coolant from the winding is understood here to mean that the coolant is taken out in the vicinity of this critical point and does not serve for cooling conductors of the winding further. The coolant can then be fed directly to a coolant supply unit. The location and number of the coolant connecting points of the winding are generally determined by design related reasons.

With this cooling arrangement it is ensured that the coolant must flow toward that point which, according to experience, goes from the superconducting to the normally conducting state first, and takes from this point at most a relatively short path through the winding berore it is discharged therefrom. In this manner, the heat transferred to the coolant at this critical point is largely prevented from being passed on to adjacent parts of the winding. The advantage of this measure is therefore that a quench will spread in the winding substantially more slowly or not at all.

In a disc shaped magnet coil winding of, for instance, D-shaped form, the conductors of which have, in the undisturbed operating condition, at least approximately the same current density I in all conductor zones and approximately the same temperature T, it is advantageous if the coolant is discharged at a coolant connecting point provided on the inside of the winding, since, in general, the conductor zones with the highest magnetic field strength H or the highest magnetic induction B are located there.

BRIEF DESCRIPTION OF THE DRAWING

The single FIGURE is a schematic illustration of a magnet coil winding with an arrangement for cooling according to the present invention.

DETAILED DESCRIPTION OF THE INVENTION

The coil winding 2, which has a disc shaped cross section and is merely indicated in the FIGURE, is of an approximately D-shaped form. A multiplicity of such coils can be combined to form a toroidal magnet system such as is provided, for instance, for Tokamak fusion reactors (see, for instance, "Rev. Mod. Phys.", vol. 47, no. 1, January 1975, pages 15 to 21). The coil is wound from a superconducting hollow conductor 3, the superconductive material of which, for instance, niobium-titanium or $Nb_3Sn$, is stabilized with normally conducting material. Appropriate conductors are known, for instance, from German Offenlegungsschrift No. 26 26 914 and U.S. Pat. No. 4,079,187. For the sake of greater clarity, the required electrical and thermal insulating devices of the coil are not shown in the FIGURE and only three turns 5 to 7 of a single winding layer of the superconducting hollow conductor 3 are shown on an exaggerated scale. The coil can also be constructed from several such winding layers. It is further protected against irreversible damage in the event that normal conduction occurs. An appropriate measure, not shown in the FIGURE, is to couple out the field energy into an ohmic resistor located outside the winding, in which the energy is dissipated (cf., "Cryogenics", June 1964, pages 153 to 165).

For cooling the coil winding 2, a forced flow of a coolant A is provided, which is pumped for this purpose through at least one cavity 9 in the interior of the hollow conductor 3.

In the operating condition, the conductors located on the inside 11 are generally subjected to higher magnetic field strengths than the conductors on the outside 12 of the winding. Assuming that the heat inflow into the coil winding 2 from the outside and the current density in the hollow conductor 3 are approximately equal at each point of the coil, the conductors 5 which are arranged on the inside 11 of the winding 2 have operating data of their superconductive material which come closest to the transition point of the superconductive material fixed by the three critical quantities mentioned above. A corresponding conductor zone is delineated in the FIGURE by a dashed line designated 14, taking additionally into consideration that this conductor zone also includes particularly the points 16 and 17 which, with the D-shaped form of the winding, have a particularly small radius of curvature. According to the illustrated embodiment, the conductors 5 of the coil 2 tend to quench soonest in this zone 14. According to the present invention, it is therefore provided that the coolant flowing through the conductor 5 is discharged from the coil winding in this region 14, i.e., that further cooling of conductors of the winding with this coolant is then no longer provided. To ensure an appropriate coolant flow, the conductor 3 was wound from the inside out around a central D-shaped winding core 19 in the fabrication of the coil winding according to the illustrated embodiment, and the coolant A is fed into the winding at the outer end 22 thereof for operating the finished coil, as is shown by an arrow 21. After the coolant has flowed through the hollow conductor from the inside out, it is discharged at an outlet 24 at the straight portion of the inside of the coil 2, as likewise indicated by an arrow 23. In this manner a quench forming in the zone 14 of the winding is prevented from being transmitted to adjacent regions of the winding by the coolant which is warmed up in the process.

In the illustrated embodiment, it was assumed that the forced cooling of the conductors is accomplished by the flow of a coolant through cavities in these conductors. However, a corresponding flow can equally well be provided on the outside of the conductors, for instance, by appropriate lengthwise canals at the conductors or in insulating parts between adjacent conductors.

What is claimed is:

1. In an arrangement for cooling a magnet coil winding containing conductors of superconductive material which are cooled by means of a forced flow of a coolant which is fed into the winding at at least one coolant connecting point and is discharged again from the winding at at least one further coolant connecting point, the conductors being subdivided into conductor zones, the operating points of which, being fixed by the current density I, the field strength H and the temperature T, have a different deviations from the transition point of the superconductive material from the superconducting to the normally conducting state which is closest in the I-H-T space and is determined by the critical current density $I_c$, the critical field strength $H_c$ and the critical temperature $T_c$, the improvement comprising, an outlet for the coolant from the winding disposed at the coolant connecting point with the comparatively shortest distance from that conductor zone of the winding, the operating point of which is comparatively closest to a transition point of the superconductive material in the I-H-T space.

2. The improvement according to claim 1, wherein the coolant connecting point for feeding in the coolant is disposed at a coolant connecting point which is closest to a conductor zone, the operating point of which is farther away from the transition point of the superconductive material than the operating point of all the other conductor zones of the winding.

3. The improvement according to claim 1 or 2 wherein the magnet coil winding has a disc shape and include conductors which have at least approximately the same currently density I and the same temperature T in all conductor zones in the undisturbed operating condition, and wherein the coolant connecting point for discharge of the coolant is disposed on the inside of the winding.

4. The improvement according to claim 3, wherein said conductors comprise superconducting hollow conductors.

5. The improvement according to claim 1, wherein said conductors comprise superconducting hollow conductors.

* * * * *